United States Patent [19]

Bush

[11] Patent Number: 4,700,435

[45] Date of Patent: Oct. 20, 1987

[54] TACK BUTTON

[75] Inventor: Earl D. Bush, Downers Grove, Ill.

[73] Assignee: Handy Button Machine Company, Melrose Park, Ill.

[21] Appl. No.: 915,537

[22] Filed: Oct. 6, 1986

[51] Int. Cl.[4] ..... A44B 1/42

[52] U.S. Cl. ..... 24/94; 24/95; 24/113 R

[58] Field of Search ..... 24/94, 95, 90 C, 113 R, 24/689, 691

[56] References Cited

U.S. PATENT DOCUMENTS

| | | | |
|---|---|---|---|
| 423,370 | 3/1890 | Bristol | 24/95 |
| 439,903 | 11/1890 | Shipley | 24/95 |
| 1,378,073 | 5/1921 | White | 24/94 |
| 1,434,491 | 11/1922 | Hubbell | 24/94 |
| 1,646,053 | 10/1927 | Clark | 24/95 |
| 1,661,616 | 3/1928 | Merzinger | 24/95 |
| 1,718,843 | 6/1929 | White et al. | 24/94 |
| 2,018,104 | 10/1935 | White | 24/95 |
| 3,358,547 | 12/1967 | Jensen | 24/94 |
| 3,440,693 | 4/1969 | Reynolds | 24/113 R |
| 3,500,506 | 3/1970 | Mitchell | 24/113 R |

OTHER PUBLICATIONS

Tool Engineers Hand Book—2nd edition—1959—two pages 54–7.

Metals Handbook—vol. 4—8th edition—1969—p. 466, (two pages).

Chipless Machining—by Charles H. Wick—1960—pp. 56–57 (two pages).

Upsetting—by National Machinery Co., p. 6—five pages.

*Primary Examiner*—Victor N. Sakran

*Attorney, Agent, or Firm*—Trexler, Bushnell, Giangiorgi & Blackstone, Ltd.

[57] ABSTRACT

A tack button utilizes a pivot tack that has a long taper on its shank which prevents buckling and a subsequent loose connection of the assembled button parts, particularly the assembly of the back member of the button with the fabric to which the button is being attached. The long tapered shank curls as the assembly process is carried out so that a curled structure is within the button shell and is positioned to clinch the back member to the fabric.

4 Claims, 8 Drawing Figures

TACK BUTTON

BACKGROUND OF THE INVENTION

This invention relates generally to button manufacture, and more particularly to an improved pivot tack button In the garment and furniture trades, pivot tacks of the type with which the present invention is concerned are inserted into the back of a covered button and are designed to lock with the button by rolling over the shank of the tack as the shank engages the steel "roof" of the insert within the button shell. In theory the gradual pressing of the tack into assembled relationship with the remainder of the button comes about by the rolling over of the shank of the tack so that the roll-over or curl supposedly formed draws the head of the tack tightly up against the fabric to which the button is being attached and also clinches the button shell and the insert rigidly together.

Presently the known design of pivot tacks provides a uniform diameter shank with a very short taper at the tip of the shank so that the point will easily penetrate the materials and enter the pivot back or button shell easily. Generally speaking, the tacks are made from wire stock with the result that as the covered button and tack are moved relatively toward one another during the button installation process the engagement of the tip of the tack with the surface of the insert causes the tack to bend sideways and only partially curl. As a result the shank of the tack does not fully contact the back member thus causing a looseness and possible separation of the button parts. If the button components are not clinched together firmly the button falls away from the garment or furniture. Thus, a uniform diameter shank and a short taper at the tip results in a structure that has a tendency to crush or buckle rather than curl uniformly inside the button to lock the parts together. Actually, the buckling of the tack shank results in a loose attachment that looks tight but can easily come apart when handled.

Another known form of pivot tack uses a taper which is longer than the typical taper confined to the point of the tack shank. However, the insert within the button and against which the tack shank impinges includes a dimple centered in order to try to deflect the shank of the tack sideways and cause it to curl. Instead, the shank often buckles.

In general the foregoing approaches to the problem of locking the button parts together have not produced satisfactory results.

OBJECTS AND SUMMARY OF THE INVENTION

An object of this invention is to provide a pivot tack button having a tack in which the shank is so designed that as the tack is driven into the cavity of the covered button shell, the shank of the tack curls evenly and locks tightly against the button back, and thereby prevents looseness of the button components and subsequent loss of the button. The foregoing results are obtained by providing on the tack a long gradual taper which extends over a major portion of the length of the tack shank. This construction prevents the shank from crushing or buckling during assembly, and the progressively increasing diameter of the shank toward the head causes the shank to curl and become tightly lodged between the button back and the button insert within the cavity of the button.

A further and inter-related object of the invention is to provide a tack button of the type stated in which a section of the tack shank adjacent to the tack head and located intermediate the tapered portion and the tack head has a length and diameter dimensioned so as to preclude the shank from buckling or crushing while at the same time providing a structure which is workmanlike and finished in appearance.

More particularly, the tack shank is a drawn wire component in which the aforesaid shank section that is intermediate the tapered portion and the head has a length which is less than about 2.5 to 3.0 times the diameter of the wire used to make the shank. Preferably, however, the aforesaid section of the tack shank adjacent to the head is preferably of a length of approximately 1.25 times the wire diameter.

Detailed Description of the Illustrated Embodiment

Figure 1:
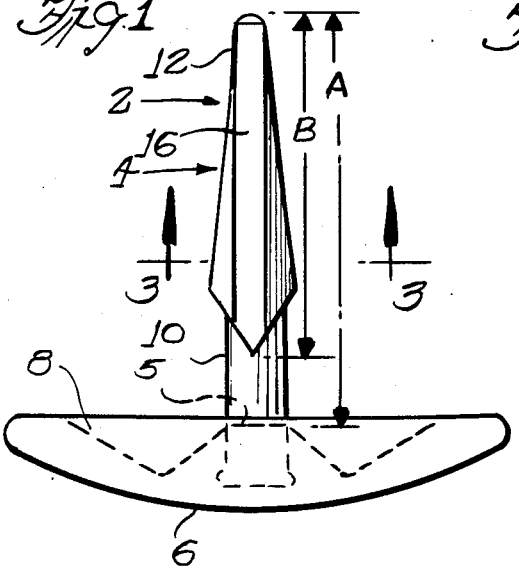
FIG. 1 is a side elevational view of a pivot tack constructed in accordance with and embodying the present invention.
Figure 2:
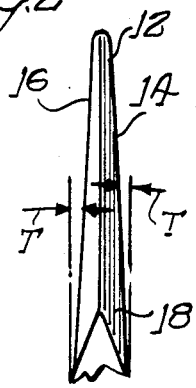
FIG. 2 is a fragmentary side view of the structure of FIG. 1.
Figure 3:
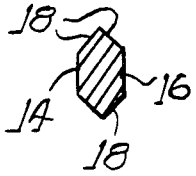
FIG. 3 is a sectional view taken perpendicular to the central axis of the shank along line 3—3 of FIG. 3.

Referring now in more detail to the drawing, which illustrates a preferred form of the present invention, there is best shown in FIGS. 1–3 a pivot tack 2 having a shank 4 and a circular head 6, the shank 4 projecting perpendicularly from the head 6 and being clinched thereto in a known manner. For example, the head 6 may be formed of a suitable sheet metal stock whereas the shank 4 is a round wire stock. The head 6 is wedged to displace the metal tightly around the end of the shank 4, which leaves a cavity 8 in the head 6.

In accordance with one form of the invention the shank 4 has a first section 10 and a second section 12 contiguous therewith. The first shank section 10 projects outwardly from the head and is part of the wire of a diameter equal to the wire diameter from which the shank is made.

In a typical embodiment of the invention an 18 gauge wire may be used, which has a diameter of 0.0475 inches. The second section 12 is of non-circular cross section and may be of the hexagonal configuration shown in FIG. 3 in which two opposing tapering sides 14, 16 are of equal width but are wider than the adjacent sides 18. The taper is formed by convergence of the sides 14, 16 in the direction of the tip, i.e., in the direction away from the head 6. The angle of taper may vary depending upon the length of the shank 4. For example, where the distance from the band of clinching 5 (typically a cylindrical band) of the head 6 to the tip of the shank (the dimension A) is approximately 0.325 inches and the distance from the tip of the shank to the end of the taper (the dimension B) is about 0.265 inches, the angle of taper T is approximately 3 degrees and the length of the first section 10 is about 0.060 inches. The angle of taper could, however, range from about 1 degree to about 5 degrees. Considering the illustration in FIG. 1 a taper is shown, but the taper may vary from 0 degrees to 10 degrees. Furthermore, in order to prevent the pin shank from buckling, the length of the first section 10 is kept within the range of less than 2.5 to 3.0 times the diameter of the wire forming the section 10. In the present example, the difference between the A and B dimensions is the length of the section 10, and this is very close to 1.25 times the diameter of the wire.

Figure 3A:
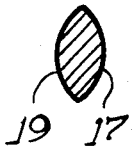
FIG. 3A is a modified form of cross section which may be suitable for the shank, also taken along line 3—3.

Alternatively the cross section of the tack shank may be as shown in FIG. 3A. In this form of the invention the flattened hexognal cross section such as shown in FIG. 3 is replaced by a cross section formed by two intersecting arcs 17, 19.

Figure 4:
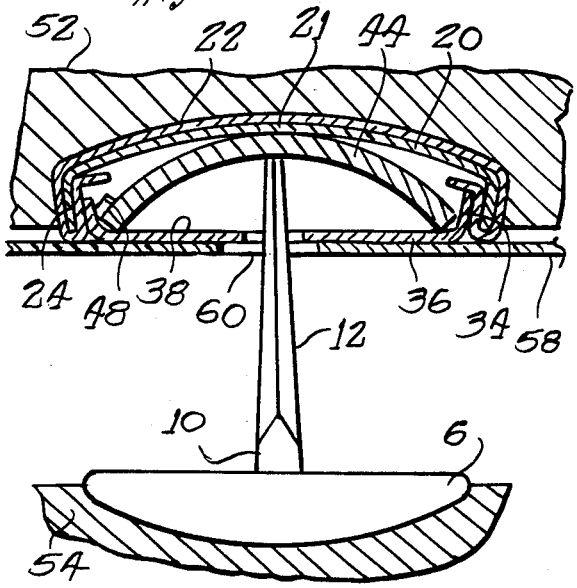
FIG. 4 shows the initial step in assembling the tack with the remainder of the covered button components.
Figure 5:
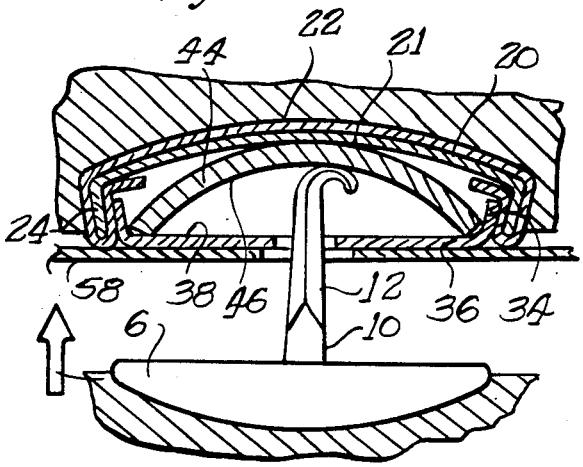
FIG. 5 is a view similar to FIG. 4 and in which the tapered lead at its tip has commenced to curl without the tack shank buckling.
Figure 6:
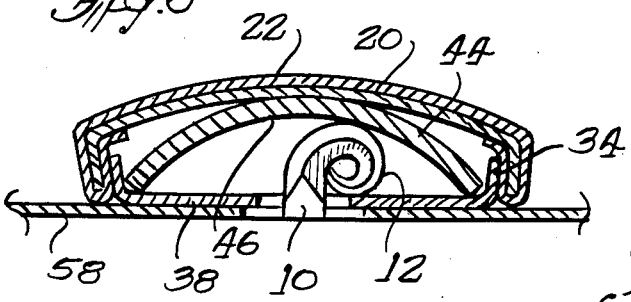
FIG. 6 is a sectional view similar to FIG. 5 and showing components of the button in their fully assembled condition and with the full curl of the tack shank being utilized to clinch the parts of the button together.

Turning now to FIGS. 4–6 there is shown a covered button comprising a thin shell 20 having a circular dome 21 and a covering 22 which is outside of the shell 20 and which has its margins inturned around the ridges of frustro-conical peripheral skirt or wall 24. The inturned portions of the button covering are clamped by a peripheral wall or flange 34 which projects axially from the central circular disc-like portion 36 on the button back member 38.

In use the button shell 20 with its covering 22 together with the button back 38 and insert 44 are assembled together in a known manner. The insert 44 has a smooth arcuate convex interior surface 46 which is presented toward the interior of the shell, namely in the direction toward the back member 38. The insert is held assembled with the back member 38 by a plurality of tabs 48, one of which is shown in FIG. 4. These tabs 48 are struck out of the flange 34 at several points around the circumference of the insert 44.

Prior to assembly the tack and the button are mounted in their respective holding dies 52, 54, diagrammatically represented in FIG. 4. The fabric 58 to which the button will be attached is disposed over the outside surface of the back member. A series of aligned openings, generally designated at 60 may be provided for or may be formed in order to access the shank 4 approximately centrally of the assembled shell, insert, and back member. As the tack moves relative to the rest of the structure, as shown progressively in FIGS. 4–6, the shank 4 will engage the arcuate surface 46 causing the shank 4 to curl progressively until the tack head 6 is drawn up against the fabric 58 and with the curl shown in FIG. 6 drawing the tack tightly up against the fabric and also permanently engaging the back member 38 so that the back member 38 tightly engages the fabric 58.

Because the taper on the shank, the cross section of the shank varies progressively from small to large over the taper. This progressive increase in the cross sectional size of the shank aids in assuring that a curl is formed during the assembly operation. Furthermore, the fact that the first section 10 of the tack shank has a length which is less than about 2.5 to 3.0 times the diameter of the section 10 aids in preventing the tack shank from buckling.

Figure 7:
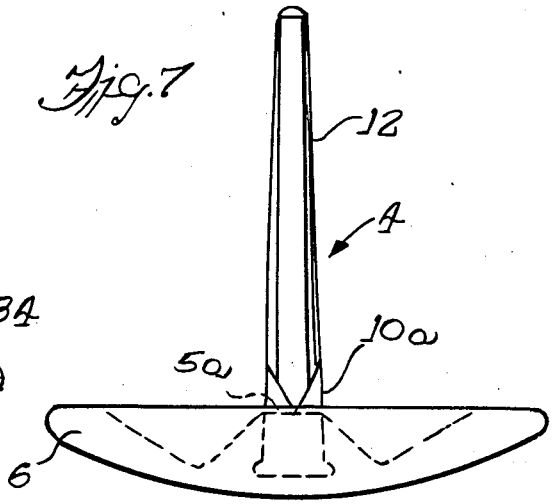
FIG. 7 is a view similar to FIG. 1 and showing a further modified form of tack in accordance with the present invention.

A modified form of tack is shown in FIG. 7. Therein the taper extends for the full length of the shank up to the narrow band of clinching **5*a* of the shank to the head 6. The portion 10*a* of the shank which corresponds in length to the first section 10 will, in the form of the invention shown in FIG. 7**, be tapered. However, the length of the first section will still be less than 2.5 to 3.0 times the wire diameter of the wire used to make the tack shank.

The invention is claimed as follows:

1. A button comprising a shell formed with a dome and a peripheral wall surrounding the dome, a cover lining the outside of the dome and wall and with said cover also extending into the interior of the shell against the inside surface of said wall, a backing member having a disc-like central portion and a flange surrounding said central portion, said flange lying within said shell and pressing against said covering and cooperating with said wall to clinch the covering material therebetween, an insert within said shell and having an arcuate interior surface presented toward said disc-like central portion, said insert having a peripheral portion adjacent to said flange and being surrounded thereby, said insert also having a central region engaging the inside surface of said dome and being sufficiently shallow to be wholly within the confines of said shell, a tack adapted to secure the aforesaid structure to a fabric sheet, said tack having a head, and a shank projecting from said head, said tack also having a central axis centered on said shank, and said arcuate interior surface being centered on said axis and extending from said axis toward the periphery of the backing member throughout 360 degrees, terminating in a periphery which is supported by said peripheral flange, said fabric sheet and said disc-like central portion having means by which said shank is received, said shank having a first section adjacent to the head and a second section remote from the head and having a free end, said second section constituting a major portion of the length of the shank and having a taper in the direction away from said head, the length of said first section being less than about 2.5 to 3.0 times the diameter of said first section and that engagement of said free end with said arcuate interior surface, and continued relative axial movement of said shank and insert causes said second section to form a curl that constitutes a means for locking the tack immovably in assembled relation to the insert and shell, all without backing of said first section.

2. A button according to claim 1 in which the curl span the space between said insert and said backing member.

3. A button according to claim 1 in which the first section is cylindrical.

4. A button according to claim 1 in which the first section has a taper.

* * * * *